United States Patent [19]

Suzuki

[11] 4,455,959

[45] Jun. 26, 1984

[54] APPARATUS FOR SUPPORTING THE MAST OF A SAILING BOARD

[76] Inventor: Haruhide Suzuki, 8-26-3 Todoroki, Setagaya-ku, Tokyo, Japan

[21] Appl. No.: 405,891

[22] Filed: Aug. 6, 1982

[30] Foreign Application Priority Data

Nov. 9, 1981 [JP] Japan ..... 56-178452

[51] Int. Cl.[3] ..... B63B 15/00

[52] U.S. Cl. ..... 114/90; 114/39

[58] Field of Search ..... 114/39, 91, 133, 204, 114/218, 363, 90

[56] References Cited

U.S. PATENT DOCUMENTS

| | | | |
|---|---|---|---|
| 3,507,240 | 4/1970 | Butler | 114/39 |
| 4,037,553 | 7/1977 | Marker | 114/39 |
| 4,273,062 | 6/1981 | Marker et al. | 114/91 |

*Primary Examiner*—Trygve M. Blix
*Assistant Examiner*—Jesûs D. Sotelo
*Attorney, Agent, or Firm*—Abelman, Frayne, Rezac & Schwab

[57] ABSTRACT

An apparatus for supporting the mast of a sailing board includes a guide rail fixedly mounted on the top face of the sailing board and extending along the length of the sailing board, a member receiving the root of the mast and slidably mounted on the guide rail to move along the length thereof, and locking pedals for selectively locking the member relative to the guide rail.

6 Claims, 3 Drawing Figures

APPARATUS FOR SUPPORTING THE MAST OF A SAILING BOARD

BACKGROUND OF THE INVENTION

The present invention relates to a sailing board known as a so-called "windsurfing board", and more particularly, to an apparatus for movably supporting the mast of such a sailing board.

In windsurfing, it may sometimes be required to move the mast along the longitudinal axis of the board body at a certain running condition. Constructions of mast supports are known in which the body of a windsurfing board includes a longitudinal slot formed therein, the slot being used to move the mast along the longitudinal axis of the board body. In the known construction, the position of the mast has been set when the mast was initially mounted on the board body at the slot. The mast cannot be moved during sailing. If the position of the mast is to be changed, the sailing must be interrupted to remove the mast from the board body and then to reset the mast at the desired position.

It is therefore an object of the present invention to provde an apparatus for supporting the mast of a sailing board, in which the position of the mast can freely be changed during sailing.

SUMMARY OF THE INVENTION

The present invention provides an apparatus for supporting the mast of a sailing board which comprises guide means adapted to be fixedly mounted on the top face of said sailing board and to extend along the longitudinal axis of said sailing board, mast mounting means slidably mounted on said guide means to move along the longitudinal axis of said guide means, and means for selectively locking said mast mounting means relative to said guide means.

According to one aspect of the present invention, the locking means includes a rack having a plurality of teeth which are formed in the top of said guide means and spaced away from each other along the longitudinal axis of said guide means, and pedal means shiftably mounted on said mast mounting means and adapted to unlock said mast mounting means from said guide means when said pedal means is depressed.

According to another aspect of the present invention, the pedal means includes at least one pedal member shiftably mounted on said mast mounting means and resiliently urged into locking position in which the inner end of said pedal member engages one of said teeth in said rack to lock said mast mounting means relative to said guide means.

BRIEF DESCRIPTION OF THE DRAWINGS

The present invention will now be described by way of example with reference to the accompanying drawings in which.

DETAILED DESCRIPTION

Figure 1:
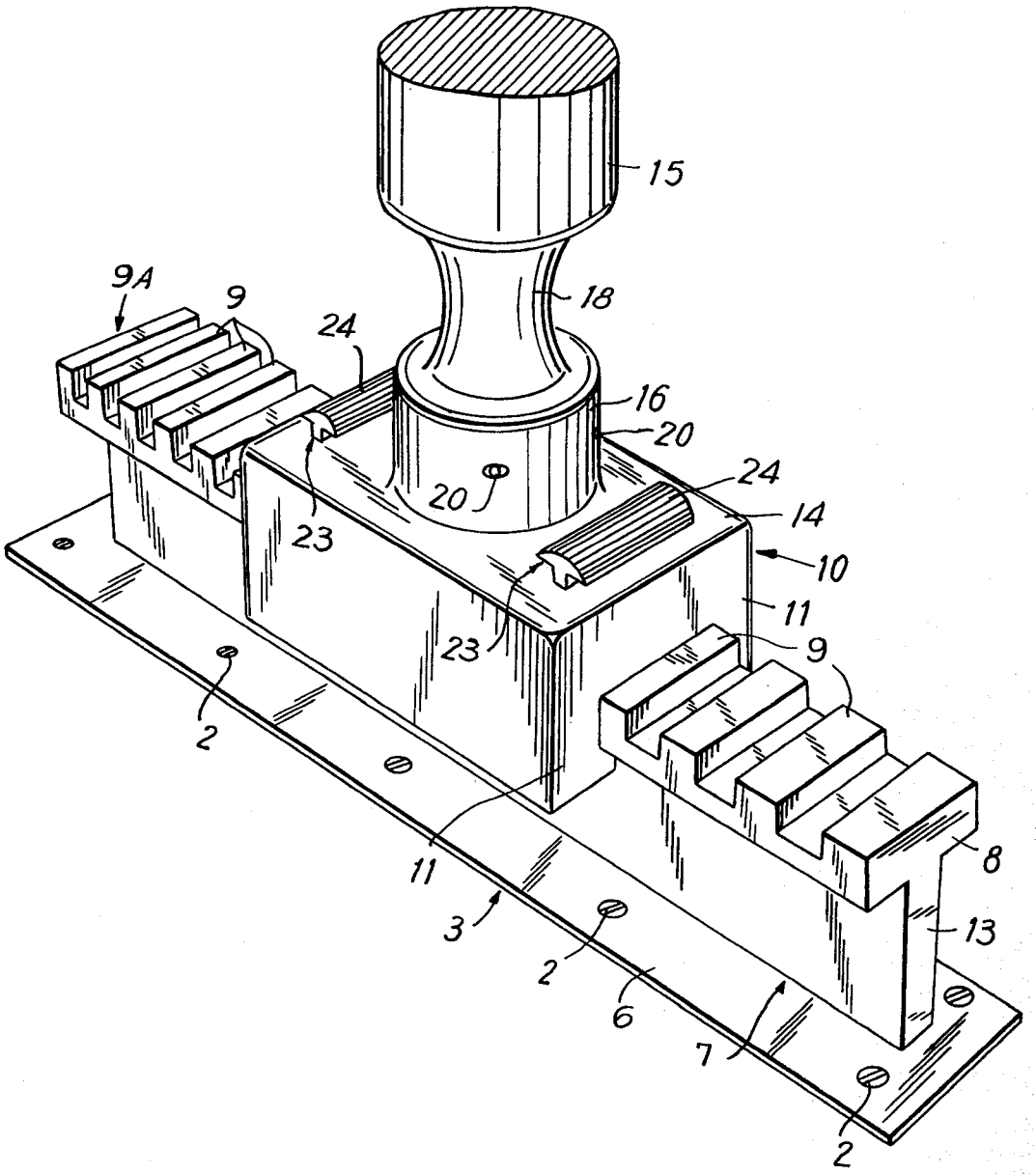
FIG. 1 is a perspective view of an apparatus for supporting the mast of a sailing board, according to the present invention.
Figure 2:
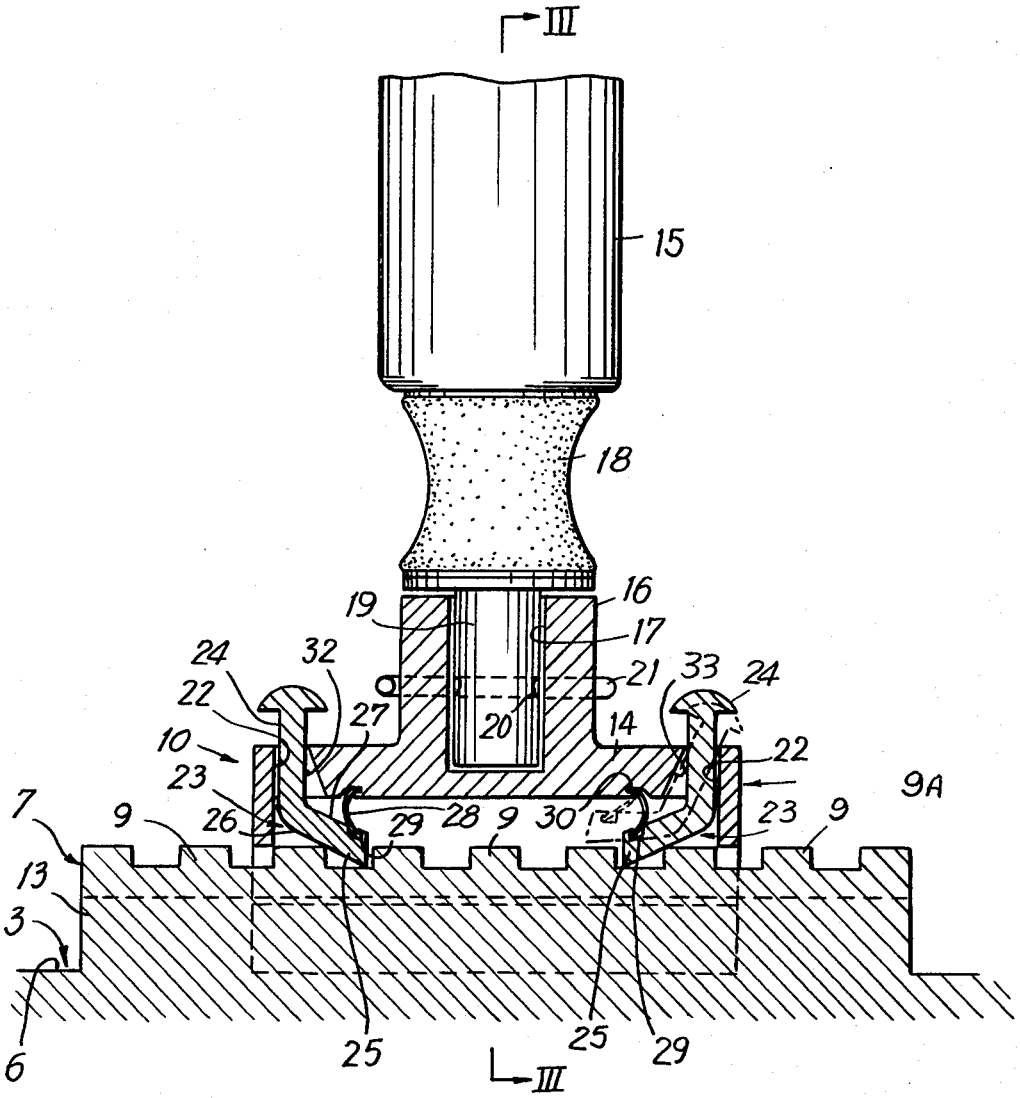
FIG. 2 is a longitudinal section of the apparaus shown in FIG. 1.
Figure 3:
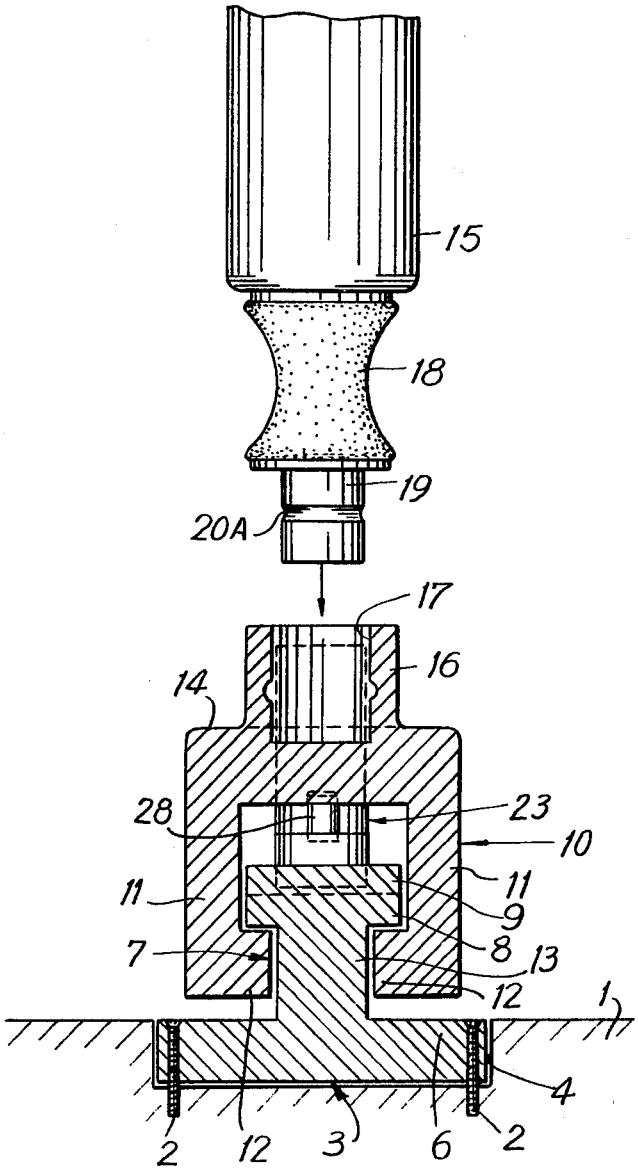
FIG. 3 is a cross-section of the apparatus shown in FIGS. 1 and 2, taken along a line III—III in FIG. 2.

Referring to FIGS. 1 to 3, a mast-supporting apparatus according to the present invention comprises guide means including a step guide rail 3 fixedly mounted on the top face of a board body 1 (FIG. 3) by means of screws 2 to extend along the length of the board body 1. In the illustrated embodiment, the step guide rail 3 is positioned within a recess 4 (FIG. 3) formed in the top face of the board body 1, but may be mounted directly on the top face of the board body without such a recess. The step guide rail 3 includes a base portion 6 used to mount the guide rail on the top face of the board body 1, a rail portion 7 of T-shaped cross-section extending upwardly and longitudinally on the base portion 6, and a rack portion 9A including a plurality of square teeth 9 which are formed in the top of the upper laterally-extending part 8 in the rail portion 7 and extend across the upper part 8.

Mast mounting means includes a mast step 10 slidably mounted on the upper part 8 of the rail portion 7 of the guide rail 3 to move along the length of the guide rail 3. In the illustrated embodiment, the mast step 10 is of substantially C-shape facing downwardly and includes side walls 11, a top wall 14 connecting the side walls 11, and an inwardly facing flange 12 extending from the lower end of each of the side walls 11. When the mast step 10 is mounted on the guide rail 3, the flanges 12 engage the upper part 8 of the rail portion 7 at the bottom faces thereof and the upright part 13 of the rail portion 7 at the sides thereof, so that the mast step 10 will be restrained from the vertical movement thereof and permitted to move along the length of the rail portion 7. A socket portion 16 receiving the lower end of a mast 15 is provided on the outer top wall 14 of the mast step 10 substantially at the center thereof. The socket portion 16 includes a blind hole 17 formed therein along the central axis thereof. In the illustrated embodiment, the blind hole 17 is adapted to receive the stub shaft 19 of a rubber joint 18 which is attached to the bottom end of the mast. It is of course that any of well-known universal joints may be used in place of the above rubber joint. The stub shaft 19 of the rubber joint 18 includes a circumferential groove 20A which is adapted to receive a joint-stop pin 21 inserted through apertures 20 in the socket portion 16 to prevent the rubber joint 18 and thus the mast 15 from separating out of mast step 10. Such an arrangement is well-known in the art and may be of any type for preventing the accidental separation of the mast 15 from the mast step 10.

The mast step 10 also includes two openings 22 formed therein through the top wall 14 and spaced apart from each other along the length of the mast step with the shaft part 16 located therebetween. A pedal member 23 is shiftably mounted within each of the through openings 22 and has a substantially J-shaped configuration which includes a foot-depressing end 24 protruding outwardly from the top wall 14 of the mast step 10 and an engagement end 25 adapted to engage the sides of the teeth 9 in the rack portion 9A of the step guide rail 3. The engagement end 25 of each pedal member 23 includes a lower sloped face 26 engaging the adjacent tooth 9 at one upper edge in a locking position shown by solid line in FIG. 2. When the pedal member 23 is moved with the lower sloped face 26 thereof faced forwardly in the direction of movement, the lower sloped face 26 slides on the top faces of the teeth 9 to permit the mast step 10 to move along the rack 9A in the same direction. If the mast step 10 is to be moved in the opposite direction, the engagement end 25 of the pedal member 23 is engaged by the side of the other tooth 9 to prevent that movement of the mast step 10. This is true to the other pedal member 23. In the solid line position shown in FIG. 2, the mast step is prevented from moving in the opposite directions by means of the pedal members 23 which thus define locking means with the teeth 9 of the rack 9A.

Each of the pedal members 23 includes a notch 29 formed therein at the upper face 27 opposed to the lower sloped face 26. The notch 29 receives one end of a spring element 28 in the form of a leaf spring. The other end of the spring element 28 is received in a similar notch 30 which is formed in the inner face of the top wall 14 of the mast step 10. The pedal member 23 is thus urged resiliently by the spring element 28 to the locking position shown by solid line in FIG. 2 in which the engagement end 25 thereof is engaged by the side of the tooth 9. This spring element 28 may assume any of other configurations rather than the leaf spring.

If one of the pedal members 23, for example, the right-hand pedal member in FIG. 2 is depressed through the end 24 forced downwardly as by the foot of an operator, that pedal member 23 can be shifted against the action of the leaf spring 28 until the inner side 32 of the foot-depressing end 24 thereof is engaged by the inner sloped side 33 of the through opening 22 as shown by broken line in FIG. 2. At this time, the engagement end 25 of the pedal member 23 is disengaged from the corresponding tooth 9 in the rack 9A. Therefore, the mast step 10 can then be moved in a direction shown by an arrow with the lower sloped side 26 of the other pedal member 23 being slid on the teeth 9. When the mast step 10 is to be moved in the opposite direction, the other pedal member 23 may be depressed and the mast step 10 moved in the opposite direction.

When the mast step 10 has been moved to the desired position on the guide rail 3, the foot-depressing end 24 of the pedal member 23 is released, so that pedal member 23 will be returned to its locking position (solid line position) under the influence of the leaf spring 28. In the locking position, the engagement end 25 thereof is engaged by the side of the corresponding tooth 9 in the rack 9A to lock the mast step 10 from any movement in the opposite direction along the step guide rail 3.

In such an arrangement, if the mast step 10 is forced to the desired direction with the foot-depressing end 24 of the corresponding pedal member 23 being forced downwardly by the foot of the operator, the mast step 10 and thus the mast 15 may easily be changed to the desired position along the length of the sailing board, even during running of the sailing board.

It is preferred that the apparatus of the present invention is made of any hard plastic material such as nylon, in view of manufacturing cost. However, it may of course be made of any of other materials.

Although the present invention has been described with the preferred embodiment thereof in connection with the accompanying drawings, it is to be understood that many changes and modifications can be effected by those skilled in the art without departing from the spirit and scope of the invention as defined in the appended claims.

I claim:

1. In a support for the mast of a sailing board of the type including guide means fixedly attachable to a top frame of the sailing board, mast mounting means movable longitudinally of the guide means, and engagement means of said guide means and said mast mounting means for locating said mast mounting means in a desired position longitudinally of said guide means:

the improvement comprising means preventing unintended release of said engagement means, and which comprise;

inter-engaging surfaces of said guide means and said mast mounting means for limiting movement of said mast mounting means to movement substantially exclusively longitudinally of said guide means and inhibiting movement of said mast mounting means in all directions transverse to said guide means;

manually operable engagement means carried by said mast mounting means and engagable within recesses in said guide means to lock said mast mounting means against displacement longitudinally of said guide means; and, means resiliently biasing said engagement means of said manually operable engagement means into locking engagement with said recesses in said guide means.

2. The mast support of claim 1, in which said guide means and said mast mounting means include cooperating interlocking longitudinally-extending track portions of complementary shape in transverse cross-section.

3. The mast support of claim 2, in which said interlocking longitudinally-extending track portions are comprised by said guide means being of T-shaped transverse cross-section, and said mast mounting means being of complementary C-shaped transverse cross-section and closely embracing the T-shaped cross-section of said guide means.

4. The mast support of claim 1, in which said manually operable engagement means includes a foot-operable lever extending through said mast mounting means and which terminates in a detent engagable between adjacent teeth of a rack provided on said guide means, the teeth of said rack extending transversely of said guide means, an inclined portion of said lever engaging an edge of one of said teeth and providing for pivoting of the detent out of engagement with the teeth upon depression of the opposite end of the lever.

5. The mast support of claim 4, including two said foot operable levers each having a detent engagable between adjacent teeth of said rack, the respective detents facing oppositely to each other and being operative to lock said mast mounting means against sliding movement relative to said guide means.

6. The mast support of claim 1, in which said resilient biasing means is a U-shaped spring reacting between said mast mounting means and said manually operable engagement means.

* * * * *